United States Patent [19]

Szova

[11] 4,006,615

[45] Feb. 8, 1977

[54] AXIAL TUMBLER LOCK

[76] Inventor: Janos Szova, 3615 Greystone Ave., Bronx, N.Y. 10463

[22] Filed: Aug. 7, 1975

[21] Appl. No.: 602,586

[52] U.S. Cl. ..... 70/363; 70/395

[51] Int. Cl.[2] ..... E05B 27/08

[58] Field of Search ..... 70/363, 419, 370, 350, 70/351, 395, 404

[56] References Cited

UNITED STATES PATENTS

| | | | |
|---|---|---|---|
| 1,851,986 | 4/1932 | Rubsamen | 70/363 |
| 3,204,437 | 9/1965 | Dreyfus | 70/350 |
| 3,380,268 | 4/1968 | Perrill | 70/363 |
| 3,415,086 | 12/1968 | Trainer | 70/370 X |
| 3,817,066 | 6/1974 | Pearson | 70/363 |

*Primary Examiner*—Robert L. Wolfe
*Attorney, Agent, or Firm*—Edward F. Levy

[57] ABSTRACT

An axial tumbler lock comprises a casing and a lock cylinder mounted in a lock body and forming a shear plane. A plurality of axial tumblers normally block notation of the casing relative to the cylinder. When a key is inserted, key posts urge the tumblers into an aligned position permitting rotation of the casing and opening of the lock. The tumblers are disposed in a nonregular pattern and a plurality of dummy pins are provided indistinguishable from the tumblers making detection of the tumblers and unauthorized operation of the lock extremely difficult.

9 Claims, 11 Drawing Figures

AXIAL TUMBLER LOCK

The present invention relates in general to locks and in particular to axial tumbler locks.

The concept of an axial tumbler lock is known in the prior art. Examples of such locks may be found in the following U.S. Pat. Nos.: H. F. George, 2,588,230; A. Tonnenessen, 2,618,957 and P. M. Trainor, 3,509,748.

The locks shown and described in the above patents feature the use of tumblers which are disposed axially in a barrel for the purpose of preventing rotation of the barrel to maintain the lock in the locked position.

The present invention features, in addition to the use of axial tumblers, a novel arrangement of the tumblers in a non-regular pattern and the use of a plurality of dummy pins, which have ends identical to the ends of the tumbler pins, thus making the arrangement of the tumbler pins impossible to detect by inspection. In addition to having a plurality of tumbler pins of different heights, which must all be brought into alignment to form a shear plane in order to rotate one part of the lock with respect to another, the axial tumbler lock according to the present invention relies for its security on varying the position and the number of the tumblers employed. The total of the possible combinations of the number of tumblers employed, the various positions of the tumblers, and the various lengths of the tumblers is extremely large and results in a lock of great security.

In an alternative embodiment of the present invention, the forward portion of the lock is stationary and axial tumblers prevent the rotation of a rotationally mounted casing with respect to the forward portion of the lock. A casing shaft projects through a central bore in the forward portion of the lock. A special key is required for this embodiment which includes a rotationally mounted plug having a plurality of key posts to slide the tumblers into alignment and a shaft for engaging and rotating the casing shaft. The requirement for a special key having both a rotationally mounted plug and a shaft for rotating the casing combined with the previously mentioned large number of possible combinations of the number of tumblers employed, the various positions of the tumblers, and the various lengths of the tumblers, results in a lock of exceptionally great security.

It is an object of the present invention to provide an axial tumbler lock having tumblers arranged in a non-regular pattern.

Another object of the present invention is to provide an axial tumbler lock having a plurality of dummy pins indistinguishable from the actual tumbler pins to prevent detection of the number and location of the actual tumblers.

Another object of the present invention is to provide an axial tumbler lock in which both the number and the arrangement of the tumblers may be varied, thus resulting in an extremely large number of possible combinations.

Still another object of the present invention is to provide an axial tumbler lock in which a key is required to slide tumblers into alignment on a shear plane and then to rotate an internal casing in order to unlock the lock.

Additional objects and advantages of the invention will become apparent during the course of the following specification, when taken in connection with the accompanying drawings, in which.

Figure 1:
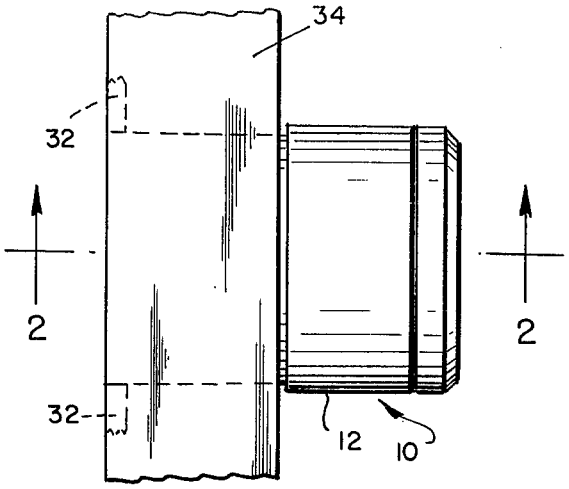
FIG. 1 is an elevation view of an axial tumbler lock according to the present invention.
Figure 2:
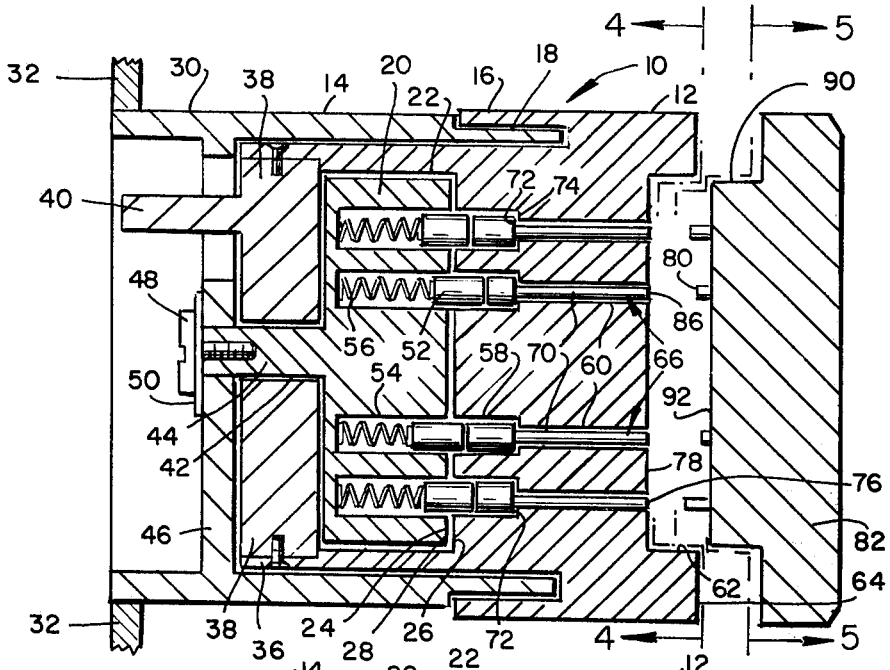
FIG. 2 is a longitudinal sectional view taken along the line 2—2 of FIG. 1, and showing a key about to be inserted into the lock.

Referring in detail to the drawings, there is shown in FIGS. 1 and 2 a preferred embodiment of an axial tumbler lock 10 made in accordance with the present invention. The lock 10 comprises a casing 12 which extends into a hollow lock body 14 and which is guided for rotation relative to the lock body 14 by a rim 16 formed on the casing 12 and extending over the surface of the lock body 14.

A lock cylinder 20 is disposed within a central bore 22 in the casing 12 and a forward surface 24 of the lock cylinder 20 is closely spaced to the surface 26 of the casing 12 forming a shear plane 28. The outer surface 30 of the lock body 14 has a pair of flanges 32 for attachment of the lock 10 to a door 34 (FIG. 1) or other structure. The end 36 of the casing 12 is secured to a plug 38 which includes a projecting latch portion 40. The plug 38 includes a central bore 42 through which a shaft 44 passes. The shaft 44 supports the lock cylinder 20 and is fastened to a support plate 46, which extends inwardly from the lock body 14, by means of screw 48 and washer 50.

Figure 11:
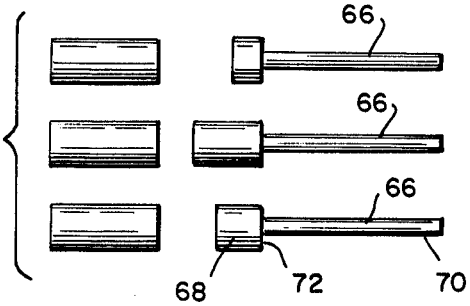
FIG. 11 is an enlarged view of three sets of tumbler parts showing the various lengths of tumbler pins which may be employed.

A plurality of lock pins 52 are provided, each slidably mounted in an axial bore 54 formed in the lock cylinder 20. Each of the bores 54 contains a compression spring 56 which urges the lock pins 52 toward the locked position shown in FIG. 2, in which a portion of each of the lock pins 52 extends into a complementary bore 58 formed in the casing 12, thus preventing rotation of the casing 12 relative to the lock cylinder 20. The bores 58 in the casing 12 each have a portion 70 of reduced diameter which extends to a counterbore 62 formed in the forward end 64 of the casing 12. A plurality of tumbler pins 66 are disposed, one each, in the bores 58. The tumbler pins 66, three of which are shown enlarged for clarity in FIG. 11, each have a portion 68 of larger diameter, matching the diameter of the lock pins 52 and a portion 70 of smaller diameter which slides within the portion 70 of the bore 58 of reduced diameter. The shoulder 72 of each of the tumbler pins 66 is urged against the shoulder 74 of the bores 58 by the respective lock pins 52 and compression springs 56. The length of the portions of reduced diameter 70 are such that the ends 76 of the tumbler pins 66 are in line with the surface 78 of the casing 12 when the lock 10 is in the locked position as shown in FIG. 2. The length of the pin portions 68 of larger diameter varies in accordance with the present invention in order to permit the lock pins 52 to extend across the shear plane 28, as shown in FIG. 2, when the lock 10 is in locked position, and in order to complement the varied length of a plurality of key posts 80 formed on a special key 82, which will be presently described.

Figure 4:
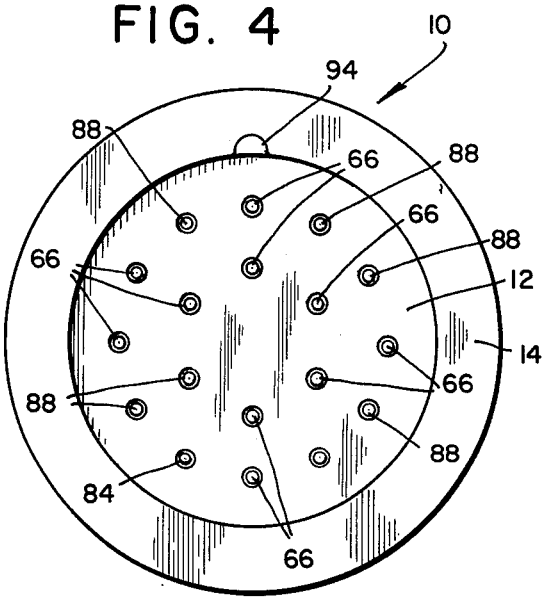
FIG. 4 is an end view of the lock taken along the line 4—4 of FIG. 2.
Figure 5:
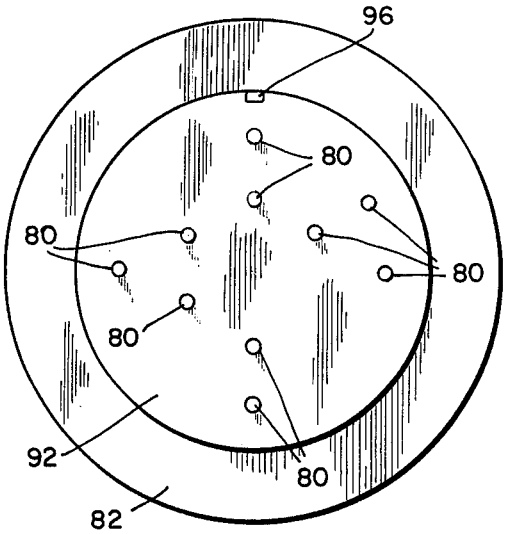
FIG. 5 is an end view of the key taken along the line 5—5 of FIG. 2.

The spacing of the bores 58 is a feature of the present invention and is shown in FIGS. 4 and 5. FIG. 4 indicates a regularly spaced array of pins 84, however, a number of the pins 84 shown are not the ends 86 of the tumbler pins 66, but are dummy pins 88 which are pressed into blind holes in the casing 12. An observer cannot tell by inspection which of the pins 84 are dummy pins 88 and which are actual tumbler pins 66 thus adding to the security of the lock 10.

Figure 3:
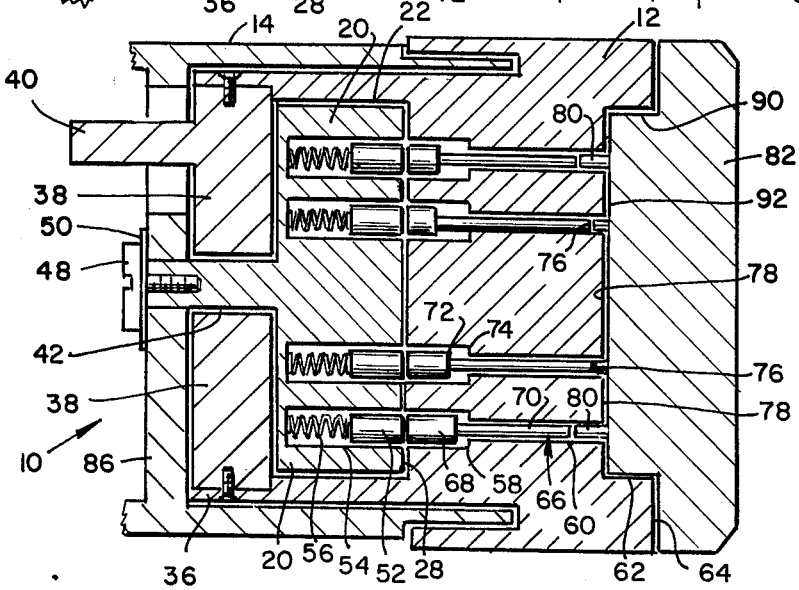
FIG. 3 is a longitudinal sectional view similar to FIG. 2, but showing the key inserted.

A key 82, for use with the lock 10, is shown in FIG. 2. The key 82 has a front portion 90, of reduced diameter, which fits the counterbore 62 in the casing 12. The forward surface 92 of the key 82 has a plurality of key posts 80 which are spaced as shown in FIG. 5, corresponding to the spacing of the tumbler pins 66 shown in FIG. 4. The key posts are of varying lengths, and the length of each of the key posts 80 is such that when the key 82 is inserted in the lock 10 as shown in FIG. 3 the key posts 80 bring the lock pins 52 into alignment on the shear plane 28. Rotation of the key 82 causes the casing 12 to rotate with respect to the lock cylinder 20 and causes the latch portion 40 to move to a disengaging position, thus unlocking the lock 10.

The casing 12 includes an index notch 94 and the key 82 includes an index mark 96, the alignment of which facilitates the insertion of the key 82 into the lock 10 in the proper orientation enabling the key posts 80 to bear against the proper tumbler pins 66.

All of the lock pins 52 must be in alignment on the shear plane 28 before the casing 12 will turn relative to the lock cylinder 20. The depressing of an individual tumbler pin 66 on the lock 10 does not reveal the location of the shear plane 28 thus making the lock 10 extremely resistant to opening by means other than the proper key 82.

The lock 10 may be used as a knob-type lock with the casing 12 being fastened to a door knob. When the key 82 is inserted into the lock 10, the casing 12 and the knob may be turned thus unlocking the door.

Figure 6:
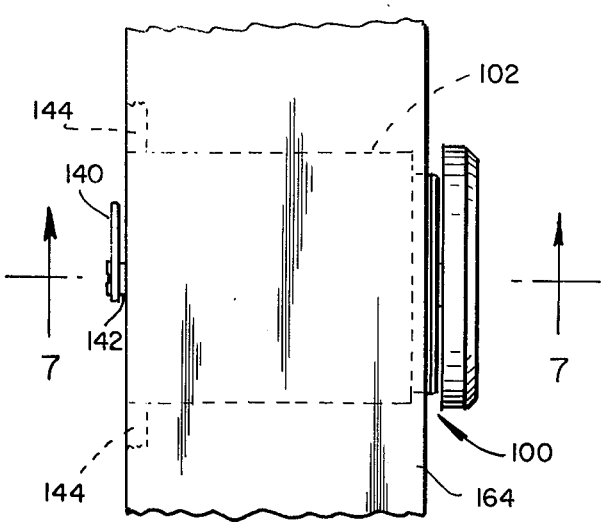
FIG. 6 is an elevation view of a second embodiment of an axial tumbler lock according to the present invention.
Figure 7:
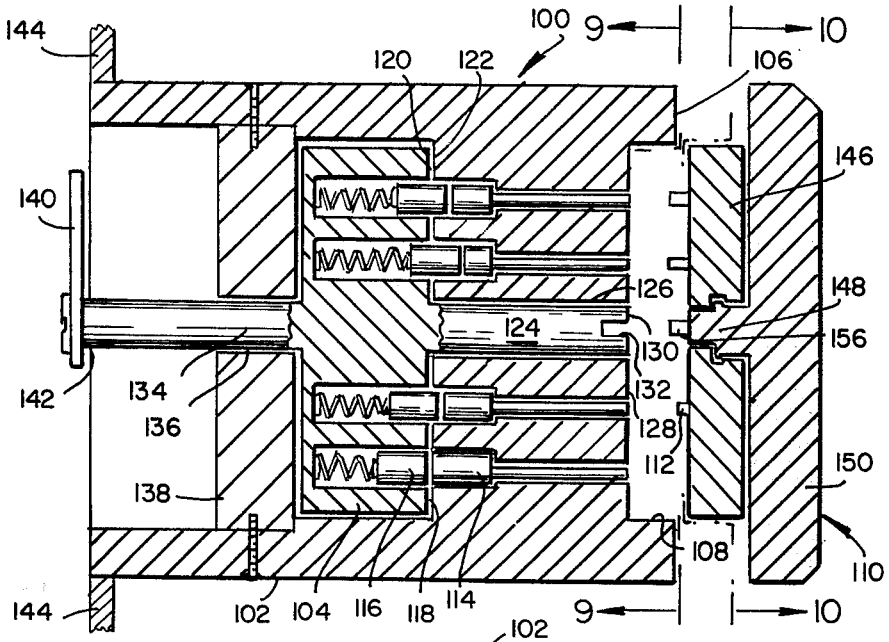
FIG. 7 is a longitudinal sectional view taken along the line 7—7 of FIG. 6 showing a key about to be inserted into the lock.
Figure 8:
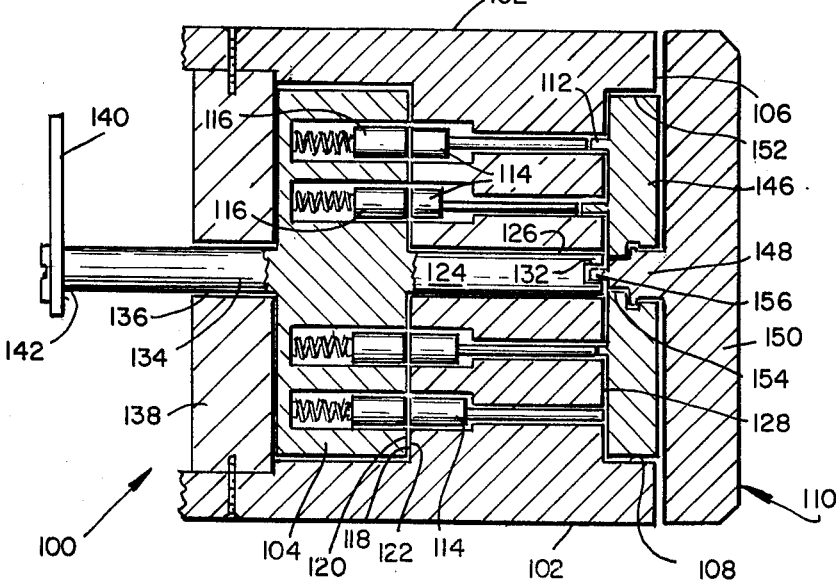
FIG. 8 is a longitudinal sectional view similar to FIG. 7, but showing the key inserted into the lock.

An alternative embodiment of a lock 100 made in accordance with the present invention is shown in FIGS. 6, 7 and 8, and features the use of an outer barrel 102 which is stationary and a rotationally mounted inner cylinder 104. The front end 106 of the outer barrel 102 of the lock 100 has a counterbored portion 108 for the insertion of a special key 110 which has a plurality of key posts 112 of varied heights which bear upon a plurality of tumbler pins 114 in order to align a plurality of lock pins 116 on a shear plane 118, which is formed between the surface 120 of the inner cylinder 104 and the surface 122 of the outer barrel 102 in a manner similar to that previously described for the lock 10.

A first shaft 124 extends from the inner cylinder 104 through a central bore 126 in the outer barrel 102 to the surface 128. The ends 130 of the first shaft includes a slot 132. A second shaft 134 extends from the inner cylinder 104 to the rear of the lock 100 through a central bore 136 in the support plate 138 which is attached to the outer barrel 102. A latch portion 140 is mounted on the end 142 of the second shaft 134. The outer barrel 102 includes a pair of attachment flanges 144 for attachment of the lock 100 to a structure 164.

Alternatively the latch portion 140 may be attached to a structure and the flanges 144 may be replaced by latch portions which turn with the outer barrel when the lock 100 is operated.

A special key 110 is required for the operation of the lock 100. The key 110 includes a plug portion 146 on which the plurality of key posts 112 are mounted. The plug portion 146 is rotatably mounted on a shaft 148 which extends from a base portion 150 of the key 110. The outer diameter of the plug portion 146 fits within the counterbore 108 of the outer barrel 102 and the front end 154 of the shaft 148 has a blade portion 156 which fits the slot 132 in the end 130 of the first shaft 124 of the inner cylinder 104 as shown in FIG. 8.

Figure 9:
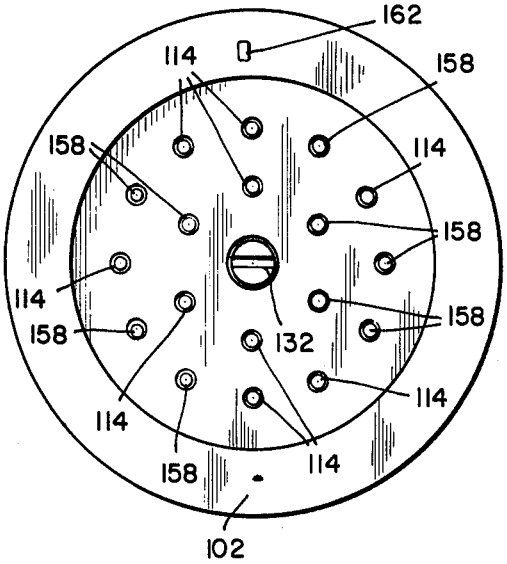
FIG. 9 is an end view of the lock taken along the line 9—9 of FIG. 7.
Figure 10:
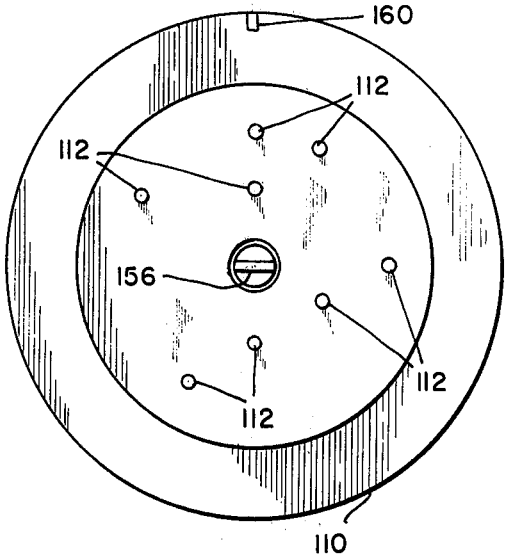
FIG. 10 is an end view of the key taken along the line 10—10 of FIG. 7.

In operation, the key 110 is inserted in the lock 100 bringing the tumbler pins 114 and the lock pins 116 into alignment on the shear plane 118 as shown in FIG. 8. The base 150 of the key 110 is then turned, thus turning the shaft 148, the first shaft 124, and the inner barrel 104, thereby turning the latch portion 140 to an unlocked position The position of the key posts 112 are shown in FIG. 10 and the position of the corresponding tumbler pins 114 are shown in FIG. 9. FIG. 9 also shows a plurality of dummy pins 158 which are pressed into blind holes in the outer barrel 102 and which are indistinguishable, in appearance, from the actual tumbler pins 114. As previously described for the lock 10, the addition of the dummy pins 158 contributes to the security of the lock 110.

The key 110 and the outer barrel 102 have index marks 160 and 162 to facilitate the insertion of the key 110 in the proper orientation. The requirement for simultaneous alignment of the tumbler pins 114 and the subsequent notation of the inner barrel 104 makes the opening of the lock 100 by means other than by the proper key 110 extremely difficult thus resulting in a lock of great security.

While preferred embodiments of the invention have been shown and described herein, it is obvious numerous additions, changes and omissions may be made in such embodiments without departing from the spirit and scope of the invention.

What is claimed is:

1. An axial tumbler lock comprising a body portion including a casing member having a plurality of axial bores extending therethrough and exposed at the forward surface thereof, a cylinder member mounted within the rear portion of said casing member with one of said members being fixed to a stationary support and the other member being rotatable relative thereto, said cylinder member having a forward surface forming a shear plane with a confronting rear surface of said casing member and having a plurality of axial bores each aligned with a corresponding bore of said casing member, latch means operatively connected to said rotatable member for movement to a lock-open position when said rotatable member is rotated relative to said fixed member, a plurality of axial tumbler means movably mounted, one each, in selected bores of said plurality of bores, each of said tumbler means comprising a lock pin slidably mounted in a respective bore of said cylinder member, a tumbler pin slidably mounted in a respective bore of said casing member and a compression spring within said cylinder member bore normally urging said lock pin to a locked position in which it extends across said shear plane between said members, thus preventing rotation of said rotatable member relative to said fixed member, said tumbler pins having varying lengths, and key means for rotating said rotatable member to move said latch means to its lock-open position, said key means comprising a body having a plurality of posts projecting from an end surface thereof and positioned for insertion into the exposed ends of the bores at the forward surface of the casing member, said pins being sized to engage said tumbler means to slide said lock pins and tumbler pins to a position in which their confronting ends are located on said shear plane thereby permitting rotation of said movable member relative to said fixed member, and a plurality of dummy pins mounted in at least some of the axial bores of said casing member.

2. An axial tumbler lock according to claim 1 in which said cylinder member is said fixed member and said casing member is rotatably mounted about said cylinder.

3. An axial tumbler lock according to claim 1 in which said casing member is said stationary member and said cylinder member is rotatably mounted within said casing member.

4. An axial tumbler lock according to claim 1 in which said tumbler means are spaced from each other in a nonregular pattern and said posts on said key body are spaced in a corresponding pattern.

5. An axial tumbler lock according to claim 1 in which said plurality of dummy pins have end portions identical to the end portions of said tumbler pins and visually indistinguishable therefrom from the exterior of the lock.

6. An axial tumbler lock according to claim 2 in which said cylinder member is secured within a lock body rotatably coupled to said casing, said lock body having flange means for attachment to an external support.

7. An axial tumbler lock according to claim 3 which also includes a cylinder shaft projecting forwardly from said cylinder through the center of said casing member to the forward surface thereof and positioned to be engaged by said key means when the latter is inserted in said lock with said posts engaging said tumbler means.

8. An axial tumbler lock according to claim 7 in which said key means comprises a base portion, a key shaft extending from said base position, a plug rotatably mounted on said key shaft, said posts being mounted on said plug, and coupling means on said key shaft positioned to engage said cylinder shaft for turning said cylinder when said key means is turned.

9. An axial tumbler lock according to claim 8 in which said cylinder shaft has a slot formed in the forward end thereof, and said coupling means comprises a blade formed on the free end of said keyshaft and sized to fit within said slot.

* * * * *